US009050234B2

(12) United States Patent
Cox et al.

(10) Patent No.: US 9,050,234 B2
(45) Date of Patent: Jun. 9, 2015

(54) CASKET HEAD INSERT MODULE

(71) Applicant: Vandor Corporation, Richmond, IN (US)

(72) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 14/024,496

(22) Filed: Sep. 11, 2013

(65) Prior Publication Data

US 2014/0068901 A1 Mar. 13, 2014

Related U.S. Application Data

(60) Provisional application No. 61/699,585, filed on Sep. 11, 2012.

(51) Int. Cl.

| | |
|---|---|
| ***A61G 17/04*** | (2006.01) |
| ***A61G 99/00*** | (2006.01) |
| ***A61G 17/02*** | (2006.01) |

(52) U.S. Cl.

CPC ..... *A61G 17/04* (2013.01); *A61G 99/00* (2013.01); *Y10T 29/49826* (2015.01); *A61G 17/02* (2013.01)

(58) Field of Classification Search

CPC ... A61G 17/0073; A61G 17/02; A61G 17/04; A61G 2017/004; A61G 2017/042; A61G 99/00; Y10T 29/49826; B65D 5/6697; B31B 2217/101

USPC ..... 27/19, 14, 16, 4, 2; 229/125.08, 125.11; 29/428; 493/102

See application file for complete search history.

(56) References Cited

U.S. PATENT DOCUMENTS

| | | | | |
|---|---|---|---|---|
| 3,077,016 | A * | 2/1963 | White | 27/19 |
| 3,395,431 | A * | 8/1968 | Carson, Jr. | 27/19 |
| 5,495,648 | A * | 3/1996 | Rojdev et al. | 27/19 |
| 5,634,247 | A * | 6/1997 | Bowling | 27/19 |
| 5,675,877 | A * | 10/1997 | Lewis | 27/19 |
| 6,151,762 | A * | 11/2000 | Cox | 27/19 |
| 6,502,287 | B2 * | 1/2003 | Mlchaud et al. | 27/19 |
| 7,478,462 | B2 * | 1/2009 | Robert et al. | 27/19 |

* cited by examiner

*Primary Examiner* — William Miller

(74) *Attorney, Agent, or Firm* — Maginot, Moore & Beck, LLP

(57) ABSTRACT

A casket lid insert module is constructed as a complete insert separate from the casket lid and is later inserted into the casket lid as a single complete piece. The module includes a base panel, four roll panels, and a center panel. The roll panels are each attached to the back side of the base panel, curved to form a roll shape, and then also attached to the front side of the base panel. The center panel is then affixed directly to the base panel between the four roll panels. The center panel is preferably affixed to the base panel using hook and loop (aka Velcro) attachments.

17 Claims, 11 Drawing Sheets

CASKET HEAD INSERT MODULE

This application claims the benefit of U.S. Provisional Patent Application Ser. No. 61/699,585, which was filed on Sep. 11, 2012, and which is incorporated herein by reference.

FIELD OF THE INVENTION

The present invention relates generally to field of caskets and cremations containers.

BACKGROUND

Burial caskets often include a decorative lid underside, or casket top interior. The casket top interior is often decorative because it is visible when a casket lid is often opened fully or partially to permit viewing of the deceased. It is thus desirable for the viewable portion of the casket top interior to be aesthetically pleasing.

To this end, the casket industry has widely employed certain decorative mechanisms in casket top interior design. One common casket top interior design includes rolls and a center panel. Rolls are shaped design features that extend inward from each edge of the casket top to form a picture frame effect. The center panel is disposed within the casket top such that the center panel is substantially bordered by the rolls. Both the center panel and rolls are typically cloth covered and hide the otherwise functional and non-aesthetic underside of the casket lid.

Because of the prominent nature of the casket top interior during the viewing, a desirable feature offered by casket manufacturers are center panels having selectable ornamental designs. The center panel design may include religious symbols, poetry, or prayer material deemed appropriate for the deceased. Such designs are typically embroidered or otherwise affixed to fabric, which is then glued or stapled to the center board. Preferably, the center panels are interchangeable such that casket consumers can select a personalized decorative center panel for installation into one of a number of standard casket models. In any event, most center panels are constructed of a semi-rigid or rigid base panel and a fabric covering.

In existing caskets, the center panel and/or rolls are affixed directly to the underside of the lid of the casket by gluing, stapling, and/or a tension/friction fit. For example, the underside of the casket lid can include channels or ledges configured such that one end of a roll panel is inserted into the underside of the casket lid and is then bent so that the other side of the roll panel can be inserted into the underside of the casket lid and the roll panel is held to the casket lid by tension. This is common in metal caskets. One disadvantage to this arrangement is that it complicates construction by requiring a more complex lid construction, including channels or ledges formed in or added to the lid that are correctly sized and arranged to receive the rolls in a tension fit. This disadvantage is particularly known in wood caskets, which require specific addition of the ledge Another disadvantage is that in order to allow for custom or at least selectable and interchangeable center panels, the construction relies on a friction fit of the center panel in the rolls, which can have reliability issues. Yet another disadvantage to this arrangement is that each piece affixed to the underside of the lid of the casket must be arranged and attached independently, increasing the risk for an irreparable error as well as labor costs.

A need, therefore, exists for a casket top interior assembly that can be easily constructed and affixed to the underside of the lid of the casket without complicating the production of the casket or increasing assembly complexity.

SUMMARY

The present invention fulfills the above need, as well as others, by providing a casket lid insert module that is constructed as a complete insert separate from the casket lid and is later inserted into the casket lid as a single complete piece. The module includes a base panel, four roll panels, and a center panel. The roll panels are each attached to the back side of the base panel, curved to form a roll shape, and then also attached to the front side of the base panel. The center panel is then affixed directly to the base panel between the four roll panels. The center panel is preferably affixed to the base panel using hook and loop (aka Velcro™) attachments.

In one embodiment of the present invention, a frame is used to facilitate construction of the casket lid insert module. Using the frame, an operator first lays the base panel onto a base of the frame. The operator then positions a roll panel relative to the base panel and affixes the roll panel to the back of the base panel. The operator then curves the roll panel over the edge of the base panel, further positions the roll panel relative to the base panel, and affixes the roll panel to the front of the base panel. The operator repeats the above steps for each of the four roll panels and then affixes the center panel to the base panel between the four roll panels.

Accordingly, the above described casket lid insert module may be easily constructed and affixed to the underside of the lid of the casket without complicating the production of the casket or increasing assembly complexity. In other words, a special lip or ledge is not required to retain the lid interior in place in a friction fit, as was the requirement with prior art devices including only the roll panels and the removable center panel.

The above features and advantages, as well as others, will become more readily apparent to those of ordinary skill in the art by reference to the following detailed description and accompanying drawings.

DETAILED DESCRIPTION

Figure 1:
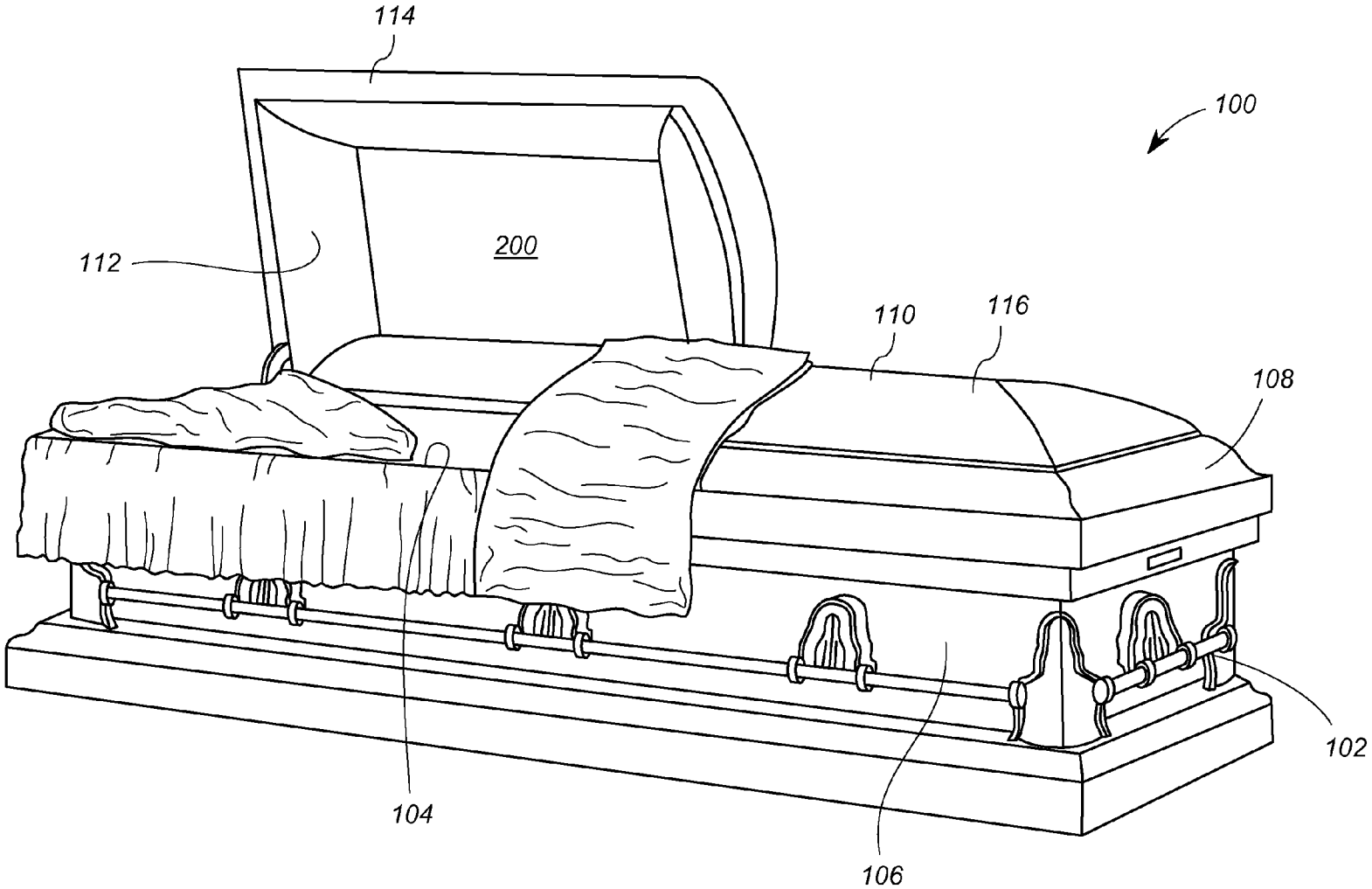
FIG. 1 depicts a perspective view of a burial casket having a casket lid insert module.

As shown in FIG. 1, the casket 100 includes a base 102, having an interior 104 and an exterior 106, and a lid 108. The lid 108 of the casket 100 is split into a head portion 114 and a foot portion 116 that can be opened and closed independently of one another. Additionally, each of the head portion 114 and the foot portion 116 can be propped open for viewing the deceased during a ceremony and/or wake. Accordingly, each of the head portion 114 and the foot portion 116 of the lid 108 includes a top side 110, which forms part of the exterior of the casket 100 when closed and forms part of the back side of the casket 100 when open, and an underside 112, which forms part of the interior of the casket 100 when closed and forms a backdrop of the casket 100 when open.

To improve the appearance of the casket 100 during viewing, a casket lid insert module 200 can be coupled to each of the undersides 112 of the head portion 114 and foot portion 116 of the lid 108, even though only one module 200 is shown on the head portion 114 in FIG. 1. When either of the head portion 114 and foot portion 116 is opened during viewing, the casket lid insert module 200 presents an aesthetically pleasing backdrop. To reduce the cost of the casket 100, the foot portion 116 can be left closed and the head portion 114 can be left open during viewing. In this case, only the underside 112 of the head portion 114 will be visible during viewing, and thus, the lid 108 need only include a casket lid insert module 200 on the underside 112 of the head portion 114. In an alternative embodiment, the casket 100 can include a lid 108 that is formed of only one piece, rather than being split into a head portion 114 and a foot portion 116. In this embodiment, the casket 100 can include a casket lid insert module 200 on the underside 112 of the entire lid 108.

Figures 2A, 2B:
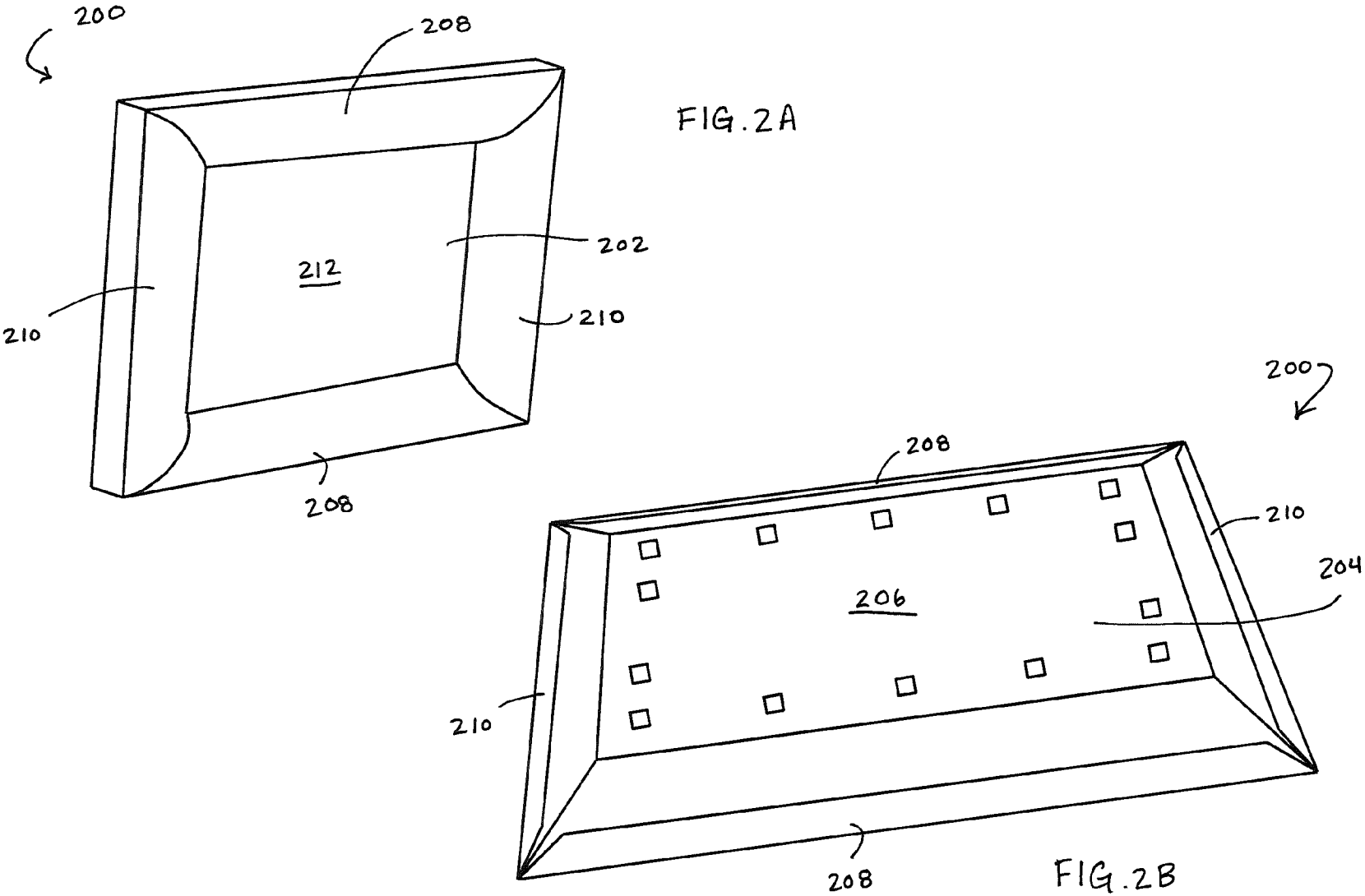
FIG. 2A depicts a front perspective view of the casket lid insert module of FIG. 1.
FIG. 2B depicts a back perspective view of the casket lid insert module of FIG. 1.

As shown in FIG. 2A and FIG. 2B the casket lid insert module 200 includes a base panel 206 (discussed below in further detail with reference to FIG. 3), two side roll panels 208 (discussed below in further detail with reference to FIG. 4A), two end roll panels 210 (discussed below in further detail with reference to FIG. 4B), and a center panel 212 (discussed below in further detail with reference to FIG. 5). Each of the two side roll panels 208 and the two end roll panels 210 are affixed to the base panel 206 on both the front 202 and the back 204 of the casket lid insert module 200. The center panel 212 is affixed to the base panel 206 and is disposed between the side roll panels 208 and the end roll panels 210 on the front 202 of the casket lid insert module 200. In this manner, the side roll panels 208 and end roll panels 210 form a "picture frame"-type structure for the center panel 212.

Figure 3:
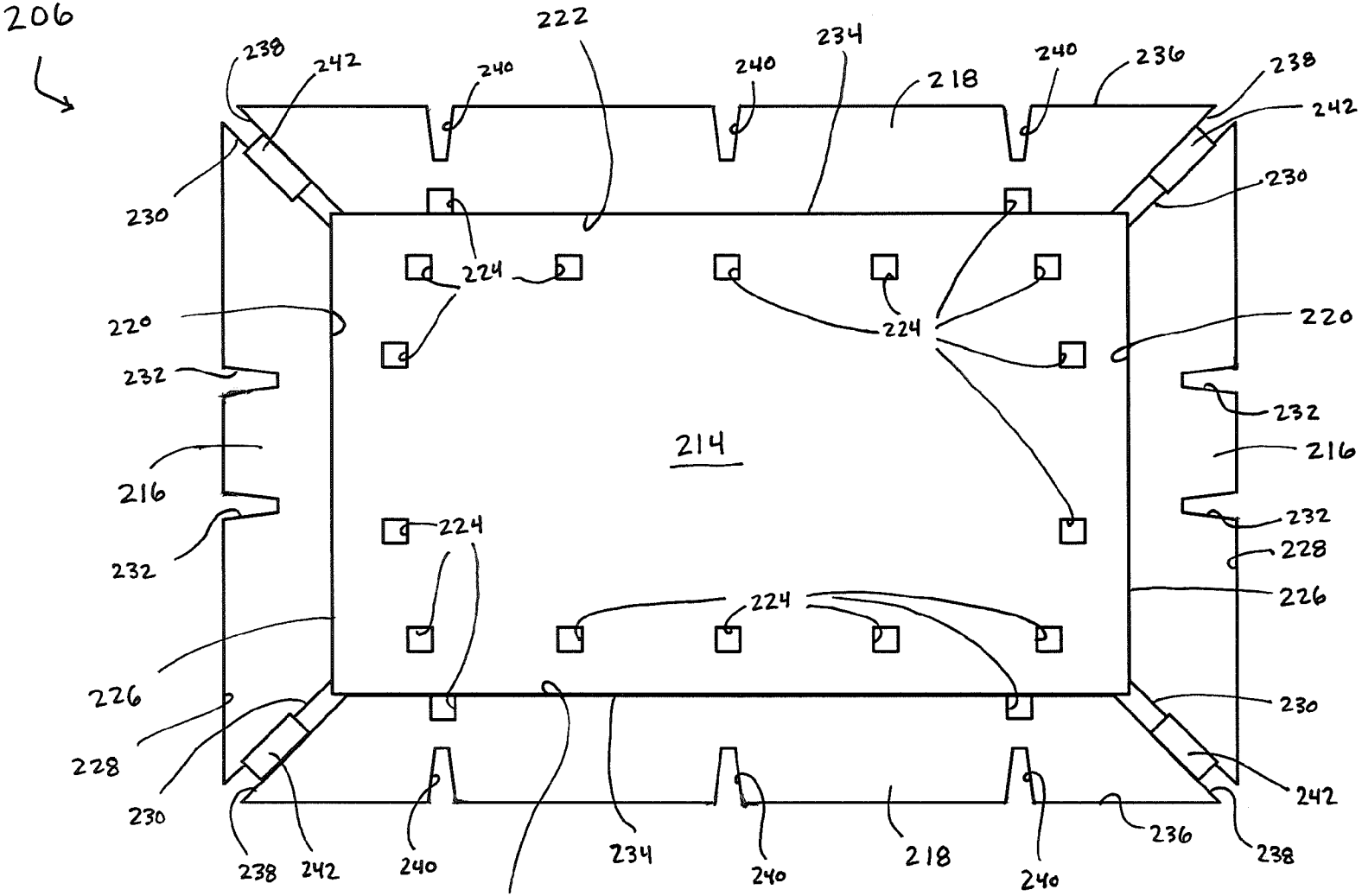
FIG. 3 depicts a top plan view of the base panel of the casket lid insert module of FIGS. 2A and 2B in a flat configuration wherein the base panel has not been assembled onto the casket lid insert module.

As shown in FIG. 3, the base panel 206 includes a base panel body 214, two base panel ends 216, and two base panel sides 218. The base panel 206 in this embodiment constructed of corrugated paper sheet, which facilitates the folding, punching, slit-scoring, through-hole punching and other known techniques to form the structures described below. The entire base panel 206 may suitably be constructed of a single piece of corrugated paper.

The base panel body 214 of the base panel 206 is substantially rectangular in shape, having two shorter base panel edges 220 and two longer base panel edges 222. The base panel body 214 is generally planar and each of the base panel ends 216 extends from one of the two shorter base panel edges 220 and each of the base panel sides 218 extends from one of the two longer base panel edges 222. The base panel body 214 also includes a number of openings 224 formed through the base panel body 214. The openings 224 in this embodiment are rectangular, and even substantially square, and are spaced apart from one another and dispersed proximate to edges 220 and 222 on the base panel body 214.

Each of the base panel ends 216 includes a base panel end fold edge 226 along the two shorter base panel edge 220 of the base panel body 214. Each of the base panel ends 216 also includes a base panel end free edge 228 opposite the base panel end fold edge 226 that is free from the base panel body 214. The base panel end free edge 228 has a greater length than the base panel end fold edge 226. Each of the base panel ends 216 also includes two base panel end angled edges 230 which extend between the base panel end fold edge 226 and the base panel end free edge 228. The base panel end angled edges 230 are opposite one another and angle from the base panel end fold edge 226 to the base panel end free edge 228 such that each base panel end 216 is substantially shaped like a trapezoid.

Each of the base panel end free edges 228 includes two base panel end notches 232 extending into the base panel end 216 from the base panel end free edge 228. The base panel end notches 232 are generally v-shaped, although they can be any other elongated shape extending into the base panel end 216 from the base panel end free edge 228. The base panel end notches 232 are spaced apart from one another along each base panel end free edge 228.

Each of the base panel sides 218 includes a base panel side fold edge 234 along the two longer base panel edge 222 of the base panel body 214. Each of the base panel sides 218 also includes a base panel side free edge 236 opposite the base panel side fold edge 234 that is free from the base panel body 214. The base panel side free edge 236 has a greater length than the base panel side fold edge 234. Each of the base panel sides 218 also includes two base panel side angled edges 238 which extend between the base panel side fold edge 234 and the base panel side free edge 236. The base panel side angled edges 238 are opposite one another and angle from the base panel side fold edge 234 to the base panel side free edge 236 such that each base panel side 218 is substantially trapezoidal in shape. Each of the base panel sides 218 also includes openings 224 adjacent to the base panel side fold edge 234 and spaced apart from one another along the base panel sides 218.

Each of the base panel side free edges 236 includes three base panel side notches 240 extending into the base panel side 218 from the base panel side free edge 236. The base panel side notches 240 are generally v-shaped, although they can be any other elongated shape extending into the base panel side 218 from the base panel side free edge 236. The base panel side notches 240 are spaced apart from one another along each base panel side free edge 236. Each of the base panel side angled edges 238 includes a tab 242 extending outwardly from the base panel side 218. The tabs 242 are foldable relative to the base panel side angled edges 238.

The base panel ends 216 and the base panel sides 218 are configured to fold relative to the base panel body 214 such that the base panel 206 is arranged in a generally concave configuration. To accommodate the folding of the base panel ends 216 and the base panel sides 218 without interference, the base panel end angled edges 230 and the base panel side angled edges 238 are configured such that they abut against one another when the base panel 206 is in the generally concave configuration. (See, e.g., FIG. 2B). When the base panel ends 216 and the base panel sides 218 are abutting, the tabs 242 on the base panel sides 218 overlap on top of a portion of the base panel ends 216. To retain the generally concave configuration of the base panel 206 when the base panel ends 216 and the base panel sides 218 are abutting, the tabs 242 on the base panel sides 218 are affixed to the base panel ends 216 where they overlap. The tabs 242 can be affixed to the base panel sides 218 using, for example, fasteners or adhesive.

Figure 4A:
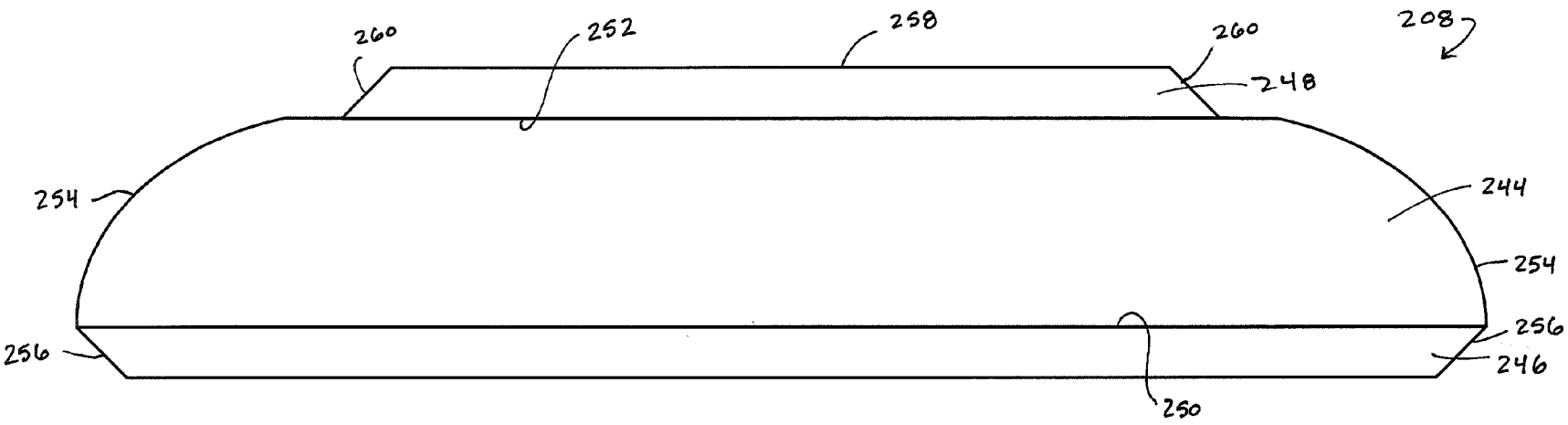
FIG. 4A depicts a top plan view of a side roll panel of the casket lid insert module of FIGS. 2A and 2B in a flat configuration wherein the side roll panel has not been assembled onto the casket lid insert module.

As shown in FIG. 4A, each side roll panel 208 is constructed of a semi-rigid, bendable material (such as paperboard) and includes a roll portion 244, a back tab 246, and a front tab 248. The roll portion 244 includes a back tab fold edge 250, a front tab fold edge 252 and two arced ends 254. The back tab fold edge 250 is greater in length than the front tab fold edge 252 and the arced ends 254 extend between the back tab fold edge 250 and the front tab fold edge 252. Accordingly, the arced ends 254 generally taper such that the roll portion 244 is narrower at the front tab fold edge 252 and wider at the back tab fold edge 250.

The back tab 246 extends from the roll portion 244 along the back tab fold edge 250 and is foldable relative to the roll portion 244. Each back tab 246 is configured to generally align with one of the base panel sides 218 (shown in FIG. 3). To this end, each back tab 246 has two back tab angled edges 256 which are configured to generally align with the base panel side angled edges 238 (shown in FIG. 3). When aligned with the base panel side 218, the back tab 246 conforms to and can be affixed to the base panel side 218.

The front tab 248 extends from the roll portion 244 along the front tab fold edge 252 and is foldable relative to the roll portion 244. Each front tab 248 is configured to lie flat on the base panel body 214 (shown in FIG. 3) while the back tab 246 is affixed to the base panel side 218. Each front tab 248 has a front tab free edge 258 opposite the front tab fold edge 252 and two front tab angled edges 260 extending between the front tab fold edge 252 and the front tab free edge 258.

To facilitate an aesthetically pleasing design, the side roll panels 208 may include a glossy or similar finish (i.e. formed of poster board), or may alternative be coated with thin fabric that has been glued thereto in a suitable manner.

Figure 4B:
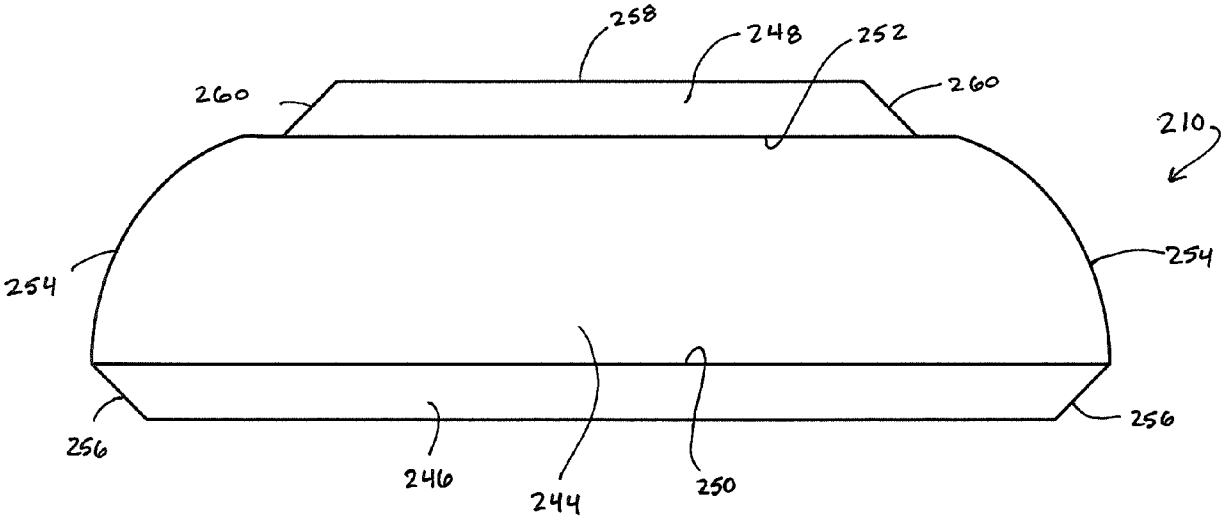
FIG. 4B depicts a top plan view of an end roll panel of the casket lid insert module of FIGS. 2A and 2B in a flat configuration wherein the end roll panel has not been assembled onto the casket lid insert module.

As shown in FIG. 4B, the end roll panels 210 are arranged and configured in substantially the same manner as the side roll panels 208 described above. The back tabs 246 of the end roll panels 210, however, are configured to conform to and be affixed to the base panel ends 216 (shown in FIG. 3) rather than the base panel sides 218. Accordingly, the end roll panels 210 are shorter in length than the side roll panels 208. More specifically, the back tab fold edge 250 of each end roll panel 210 is shorter than the back tab fold edge 250 of each side roll panel 208, the front tab fold edge 252 of each end roll panel 210 is shorter than the front tab fold edge 252 of each side roll panel 208, and the front tab free edge 258 of each end roll panel 210 is shorter than the front tab free edge 258 of each side roll panel 208.

Figure 5:
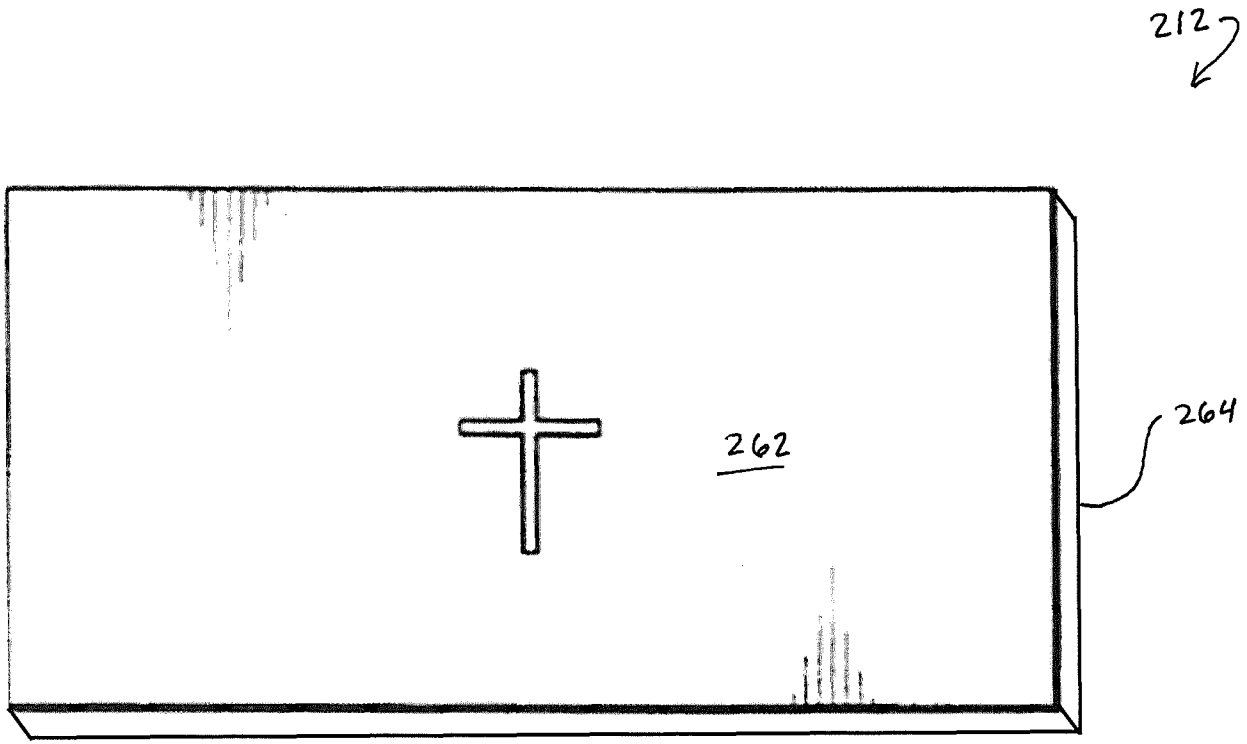
FIG. 5 depicts a top plan view of the center panel of the casket lid insert module of FIGS. 2A and 2B wherein the center panel has not been assembled onto the casket lid insert module.

As shown in FIG. 5, the center panel 212 includes a center panel top side 262 and a center panel bottom side 264 opposite the center panel top side 262. The center panel top side 262 can include an ornamental design or is otherwise aesthetically pleasing. To this end, an ornamental fabric may be used to cover the top side 262, with edge portions glued or stapled to the underside 264. The center panel bottom side 264 is configured to be affixed to the base panel 206 (shown in FIG. 3) such that the center panel top side 262 faces away from the base panel 206 and is visible when the casket lid insert module 200 is assembled as shown in FIGS. 2A and 2B. The center panel 212 is sized and configured to fit between the roll portions 244 of the side roll panels 208 (shown in FIG. 4A) and the end roll panels 210 (shown in FIG. 4B) when the side roll panels 208 and the end roll panels 210 are affixed to the base panel 206 as shown in FIGS. 2A and 2B.

Figure 6A:
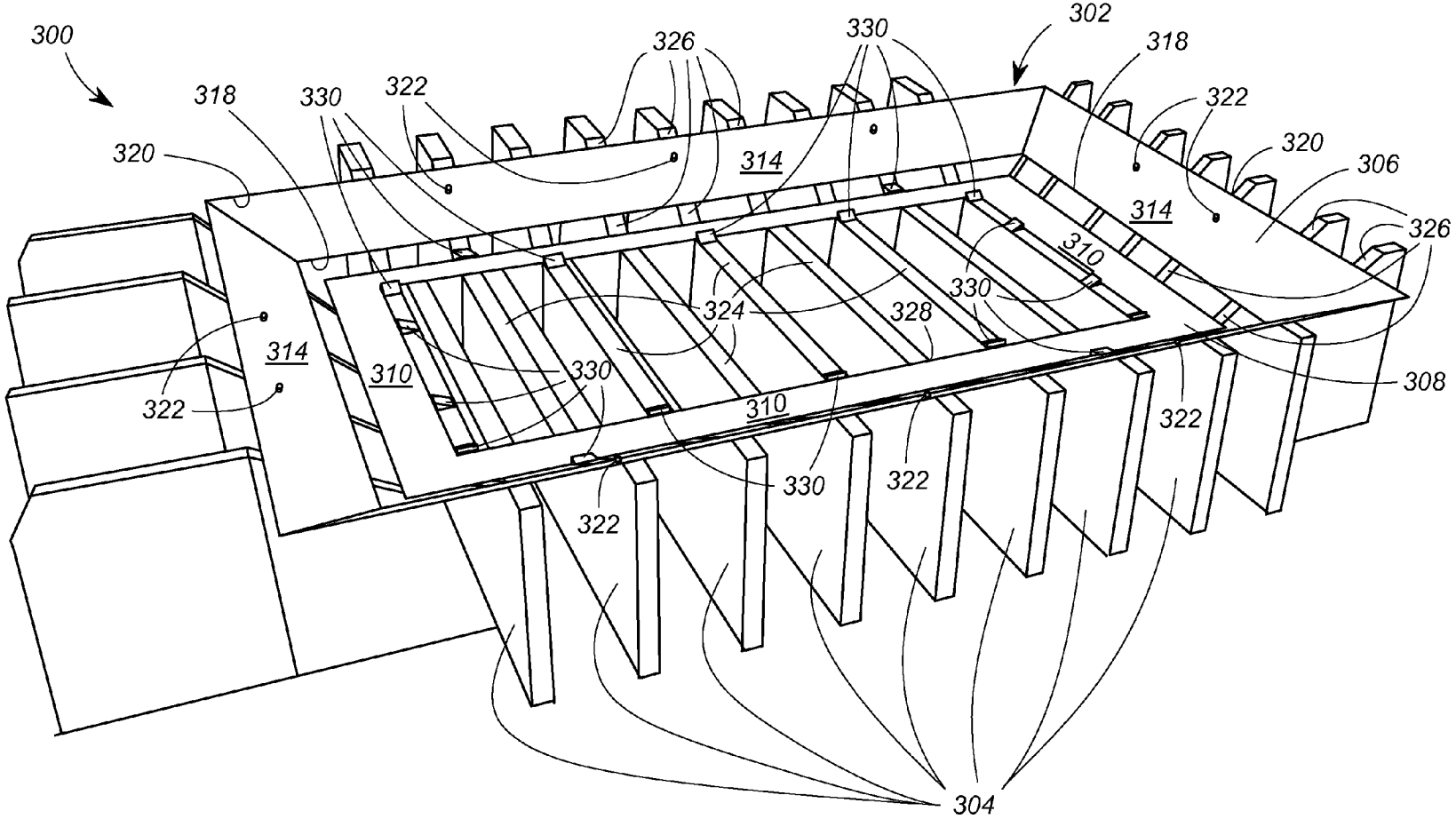
FIG. 6A depicts a perspective view of a frame for facilitating construction the casket lid insert module of FIGS. 2A and 2B.

An exemplary method of assembling the casket lid insert module 200 as shown in FIGS. 2A and 2B employs a rigid frame 300 shown in FIG. 6A configured to receive the components of the casket lid insert module 200 as shown in FIGS. 7A-7H. With reference now to FIG. 6A, the frame 300 or fixture includes a tray component 302 and a plurality of fins 304. The tray component 302 can be constructed of metal or, alternatively, some other material having similar characteristics of hardness and rigidity. The fins 304 can be constructed of wood, layered corrugated paper, or, alternatively, some other material having similar characteristics of hardness and rigidity.

With continued reference to FIG. 6A, the tray component 302 includes an outer tray 306 and an inner tray 308 spaced apart from one another and supported by the fins 304. The inner tray 308 is constructed of four inner tray beams 310 arranged to form an inner tray perimeter 312 that is substantially rectangularly shaped and is substantially planar. The outer tray 306 consists of four outer tray beams 314 arranged to form an outer tray perimeter 316 that is generally concentric to the inner tray perimeter 312. The outer tray perimeter 316 includes an innermost edge 318 and an outermost edge 320. The outer tray beams 315 are angled relative to one another around the outer tray perimeter 316 such that the outermost edge 320 is higher than the innermost edge 318. The outer tray 306 also includes pins 322 protruding inwardly toward the inner tray 308 from each of the outer tray beams 314.

The fins 304 provide support for the tray component 302 in the frame 300. To this end, the fins 304 include grooves 328 to receive and support the tray component 302. The grooves 328 arranged on the flat portions 324 are sized and configured to support the inner tray 308 and the grooves 328 arranged on the angled portions 326 are sized and configured to support the outer tray 306.

Figure 6B:
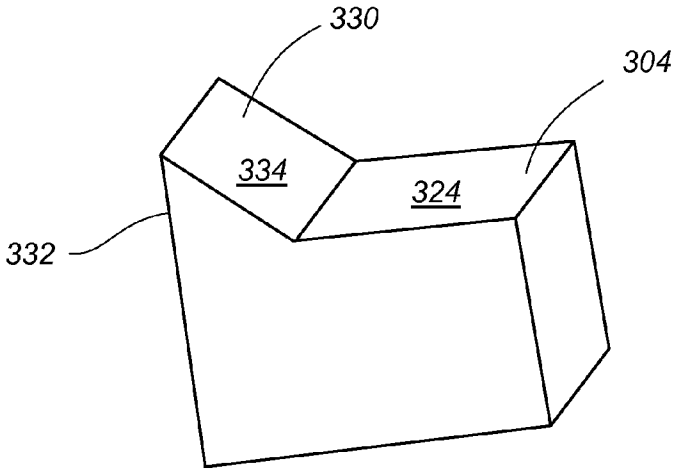
FIG. 6B depicts a perspective fragmentary view of a stop of the frame of FIG. 6A.

The fins 304 also include stops 330 extending upwardly from the fins 304. For clarity, FIG. 6B shows a close-up perspective view of the stop 330. Each stop 330 includes a stop face 332 that is substantially perpendicular to the flat portions 324 of the fins 304. Each stop face 332 is oriented such that it faces the inner tray 308 (shown in FIG. 6A). Each stop 330 also includes an angled face 334 extending between the stop face 332 and the flat portion 324 on the fin 304. Each angled face 334 is oriented to face away from the stop face 332. In other words, each angled face 334 is oriented such that it faces away from the inner tray 308 (shown in FIG. 6A).

Figure 7A:
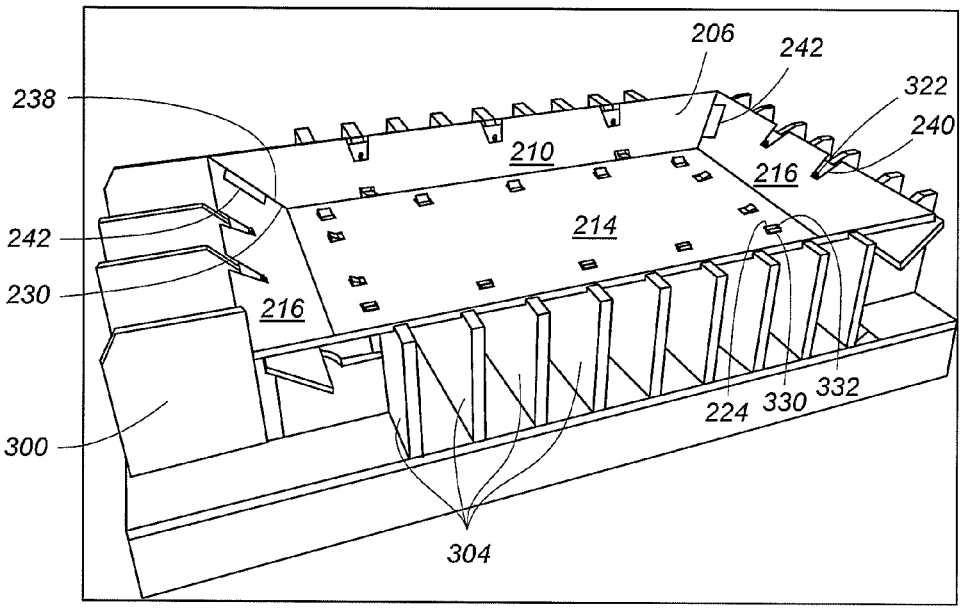
FIGS. 7A through 7H depict a series of steps for construction of the casket lid insert module of FIGS. 2A and 2B using the frame of FIG. 6A.

As shown in FIGS. 7A-7H, an exemplary method of constructing the casket lid insert module 200 shown in FIGS. 2A and 2B utilizes the frame 300 shown in FIG. 6A. Initially, a substantially unfolded blank of the base panel 206 as shown in FIG. 3 is provided. As shown in FIG. 7A, the base panel 206 is inserted into the frame 300. The inner tray 308 (visible in FIG. 6A) is sized and configured to receive the base panel body 214 of the base panel 206 such that the base panel body 214 is substantially flat within the frame 300. The outer tray 306 (visible in FIG. 6A) is sized and configured to receive and support the base panel ends 216 and the base panel sides 218 in an inclined configuration. As described above with reference to FIG. 6A, the outer tray beams 214 of the outer tray 306 are angled toward the inner tray 308. In particular, the outer tray beams 214 are arranged such that, when the base panel 206 is mounted on the frame 300, the base panel side angled edges 238 abut the base panel end angled edges 230. In this arrangement, the tabs 242 on the base panel sides 218 are be affixed to the base panel ends 216 to maintain the concave configuration of the base panel 206.

When the base panel is disposed on the frame 300, the fins 304 provide additional support to the base panel body 214, base panel ends 216, and base panel sides 218. In particular, the flat portions 324 (visible in FIG. 6A) are shaped and arranged to mate with the base panel body 214 and the angled portions 326 (visible in FIG. 6A) are shaped and arranged to mate with the base panel sides 218 and the base panel ends 216 in the concave configuration. Accordingly, the frame 300 supports the components of the casket lid insert module 200 to facilitate construction of the casket lid insert module 200.

As described above, the pins 322 extend from the outer tray beams 314 toward the inner tray 308. In particular, the pins 322 are arranged such that, when the base panel 206 is within the frame 300, the pins 322 extend through the notches 240 on the base panel ends 216 and base panel sides 218. In other words, when the base panel 206 is within the frame 300, the pins 322 do not interfere with the base panel 206.

As described above, the stops 330 extend upwardly from the fins 304. In particular, the stops 330 are sized and configured to extend through the base panel openings 224 when the base panel 206 is received in the frame 300 as shown in FIG. 7A. Each stop face 332 contacts the base panel 206 within a base panel opening 224 thereby helping to orient the base panel 206 relative to the frame 300 and to maintain the position of the base panel 206 relative to the frame 300 during construction of the casket lid insert module 200.

Figure 7B:
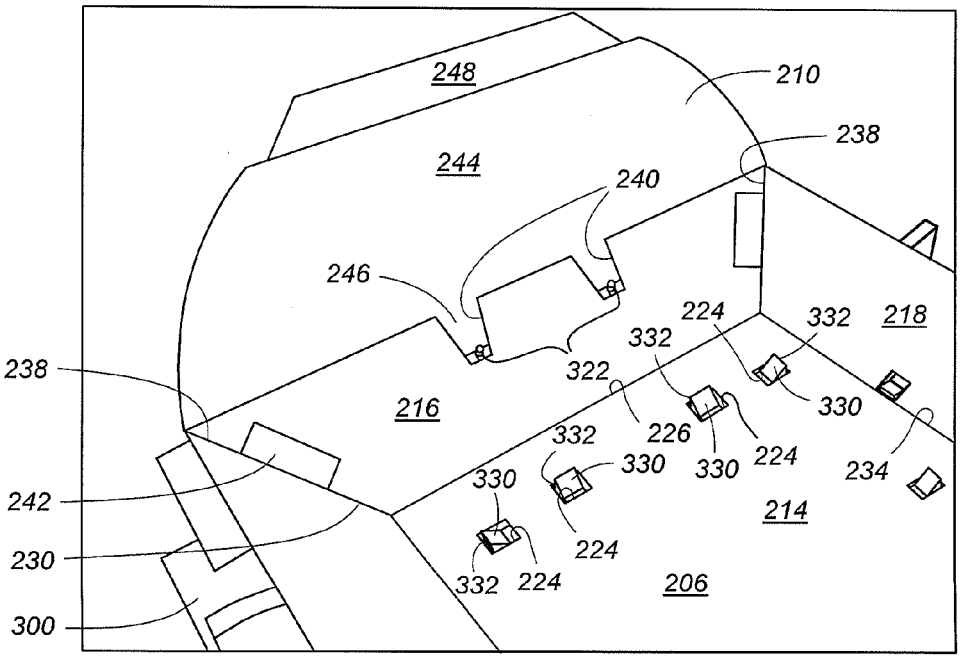

Once the base panel 206 is formed and retained in the concave configuration, the side roll panels 208 and end roll panels 210 can be attached to the base panel 206. As shown in FIG. 7B, an end roll panel 210 is inserted between the frame 300 and the base panel end 216. The back tab 246 of the end roll panel 210 is inserted first and is stopped by contact with the pins 322 extending from the outer tray beams 314. Thereafter, the end roll panel 210 is further positioned relative to the base panel end 216 by aligning the back tab angled edges 256 with the base panel end angled edges 230. The back tab 246 is then secured in this position relative to the base panel end 216. The back tab 246 can be secured to the base panel end 216 using adhesive and/or fasteners.

Figure 7C:
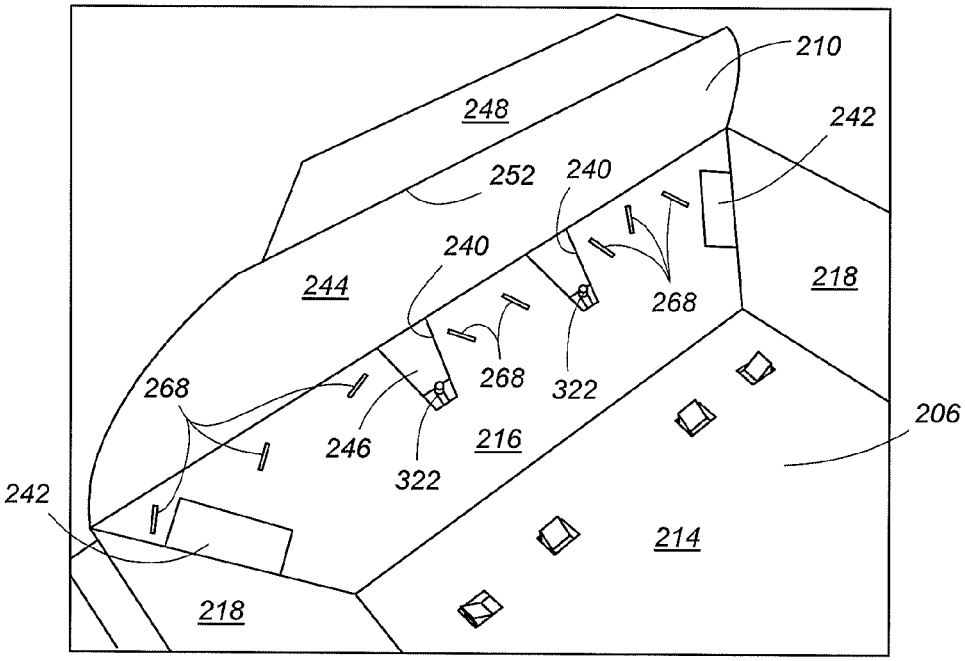

In one exemplary embodiment, shown in FIG. 7C, the back tab 246 is secured to the base panel end 216 with a plurality of staples 268. The staples 268 can be inserted through the base panel end 216 and extend through the back tab 246. After passing through both the base panel end 216 and the back tab 246, the staples 268 are then bent, securing them into place, upon contact with the hard outer tray beams 314 (visible in FIG. 6A). In this way, the end roll panel 210 is secured relative to the base panel 206.

Figure 7D:
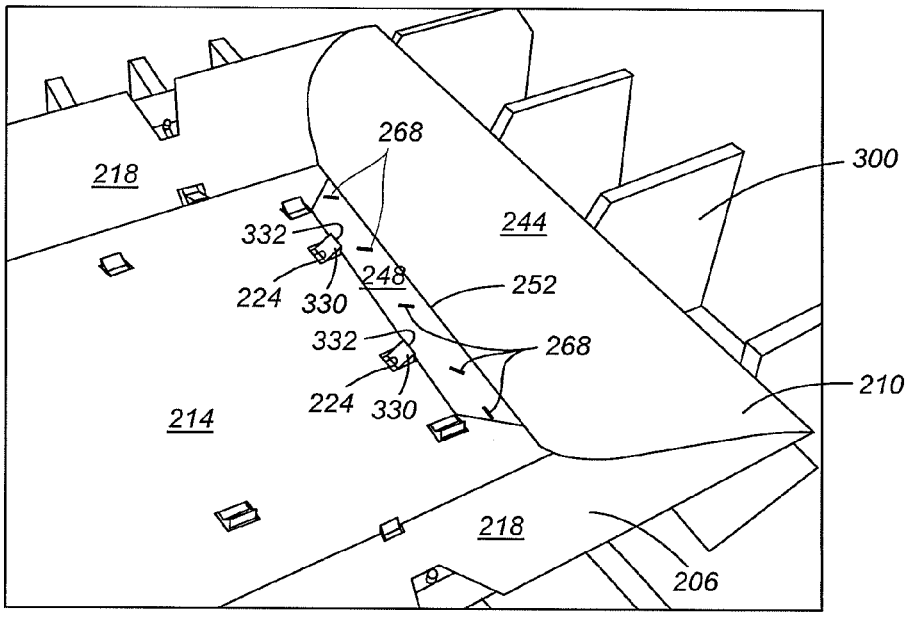

Following affixation of the back tab 246 of the end roll panel 210 to the base panel end 216 of the base panel 206, the end roll panel 210 is further secured to the base panel as shown in FIG. 7D. In particular, the end roll panel 210 is folded along the back tab fold edge 250 such that the roll portion 244 extends inwardly toward the base panel body 214. The roll portion 244 is then slightly bent into a curved configuration toward the base panel body 214. The roll portion 244 is bent such that the front tab free edge 258 contacts the base panel body 214 and the stop faces 332 of the stops 330 extending through the base panel openings 224. The end roll panel 210 is then folded along the front tab fold edge 252 such that the front tab 248 lies substantially flatly on the base panel body 214 and the front tab free edge 258 remains in contact with the stop faces 332. The front tab 248 can then be secured in position to the base panel body 214. The front tab 248 can be secured to the base panel body 214 using adhesive and/or fasteners.

In one exemplary embodiment, shown in FIG. 7D, the front tab 248 is secured to the base panel body 214 with a plurality of fasteners in the form of staples 268. The staples 268 can be inserted through the front tab 248 and extend through the base panel body 214. After passing through both the front tab 248 and the base panel body 214, the staples 268 are then bent, securing them into place, upon contact with the hard inner tray beams 310 (visible in FIG. 6A). In this way, the end roll panel 210 is bent into its curved configuration and is further secured in this position relative to the base panel 206. Because the end roll panel 210 curves around the base panel end 216 to the base panel body 214, the staples used to affix the end roll panel 210 to the back of the base panel end 216 are now hidden from view.

Figure 7E:
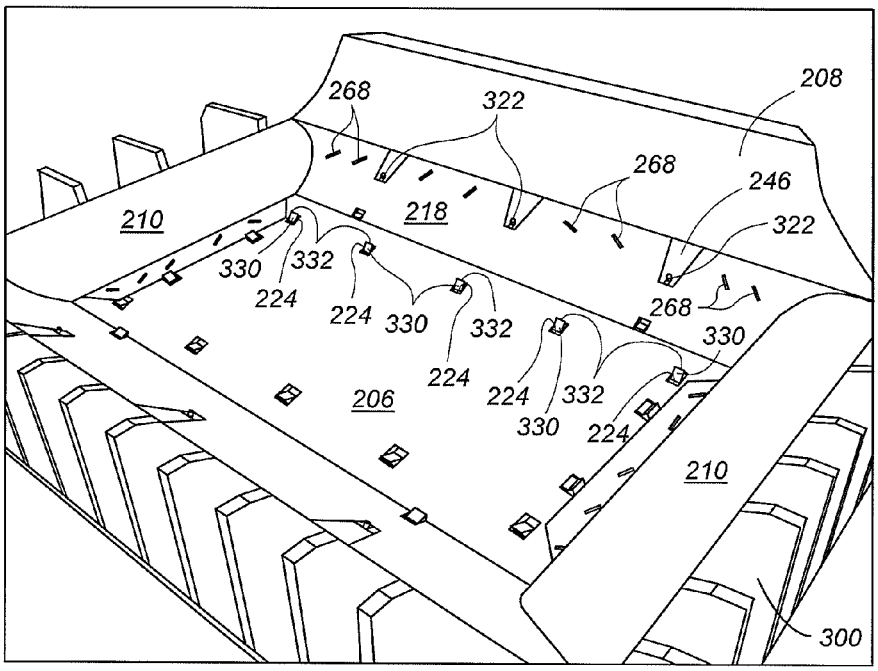

Each of the end roll panels 210 is attached to the base panel 206 in the manner described above. Following attachment of both end roll panels 210 to the base panel 206, the side roll panels 208 are attached to the base panel 206 in a substantially similar manner. First, as shown in FIG. 7E, the side roll panel 208 is inserted between the frame 300 and the base panel side 218. The back tab 246 of the side roll panel 208 is inserted first and is stopped by contact with the pins 322 extending from the outer tray beams 314 (shown in FIG. 6A). Thereafter, the side roll panel 208 is further positioned relative to the base panel side 218 by aligning the back tab angled edges 256 (shown in FIG. 4B) with the base panel side angled edges 238 (shown in FIG. 3). The back tab 246 is then secured in this position relative to the base panel side 218. The back tab 246 can be secured to the base panel side 218 in the manner described above with reference to the end roll panels 210.

Figure 7F:
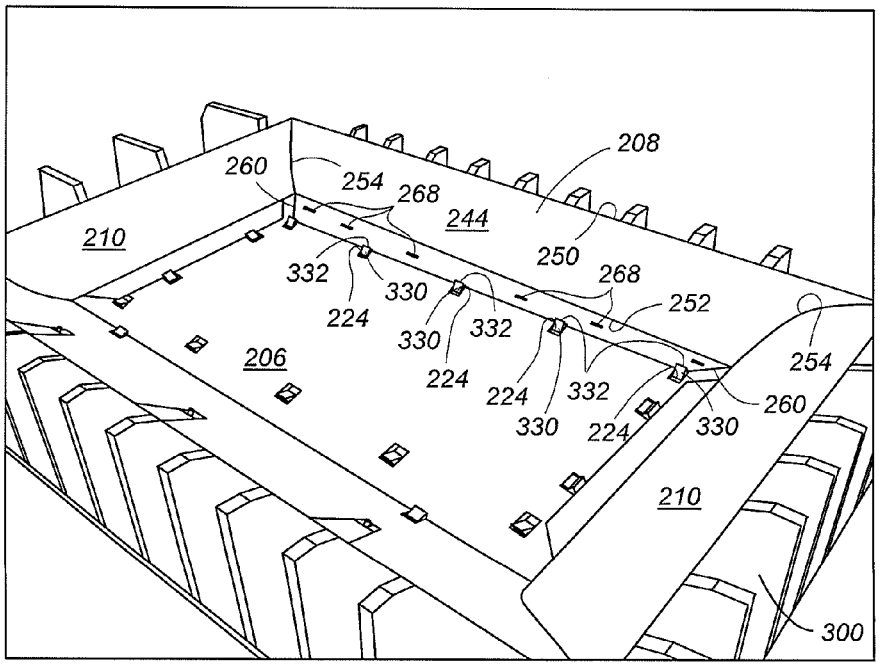

Following affixation of the back tab 246 of the side roll panel 208 to the base panel side 218 of the base panel 206, the side roll panel 208 is further secured to the base panel 206 as shown in FIG. 7F. The side roll panel 208 is folded along the back tab fold edge 250 such that the roll portion 244 extends inwardly toward the base panel body 214. The roll portion 244 is then slightly bent into a curved configuration toward the base panel body 214. The roll portion 244 is bent such that the front tab free edge 258 contacts the base panel body 214 and the stop faces 332 of the stops 330 extending through the base panel openings 224. The side roll panel 208 is then folded along the front tab fold edge 252 such that the front tab 248 lies substantially flatly on the base panel body 214 and the front tab free edge 258 remains in contact with the stop faces 332. In this curved configuration, the arced ends 254 of the side roll panel 208 contacts and abuts an arced end 254 of each of the end roll panels 210. Additionally, the front tab angled edges 260 of the side roll panel 208 accommodate a front tab angled edge 260 of each of the end roll panels 210. In other words, the front tab angled edges 260 are configured such that the front tab 248 of the side roll panel 208 does not interfere with the front tab 248 of the end roll panel 210 when affixed to the base panel 206. The front tab 248 of the side roll panel 208 can then be secured in position to the base panel body 214 in the manner described above with reference to end roll panels 210.

Figure 7G:
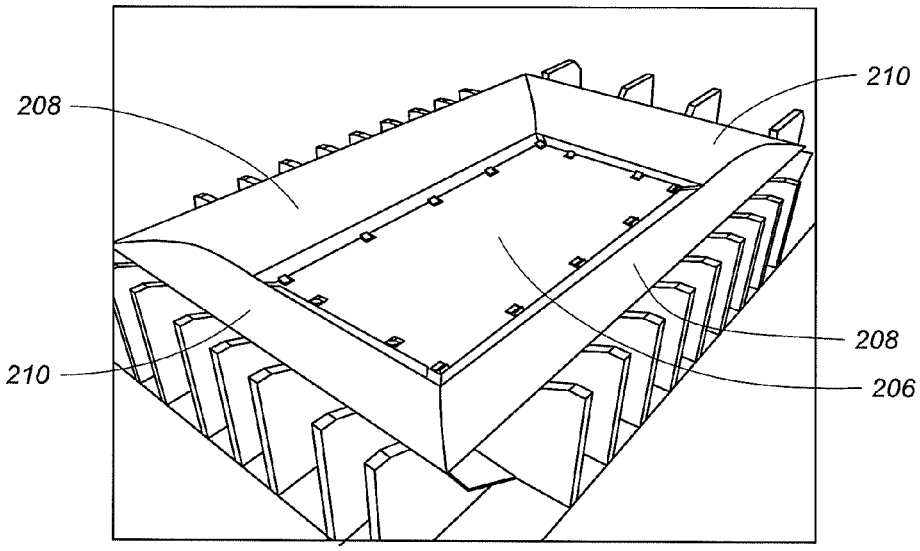

As shown in FIG. 7G, each of the side roll panels 208 is attached to the base panel 206 in the manner described above. Following attachment of both end roll panels 210 and both side roll panels 208 to the base panel 206, the center panel 212 (shown in FIG. 5) can be attached to the base panel 206 to complete the casket lid insert module 200 as shown in FIGS. 2A and 2B. As discussed above, the center panel 212 is sized and configured to fit between the side roll panels 208 and the end roll panels 210. Accordingly, the center panel 212 can be attached to the base panel 206 without interfering with any of the side roll panels 208 or end roll panels 210.

Figure 7H:
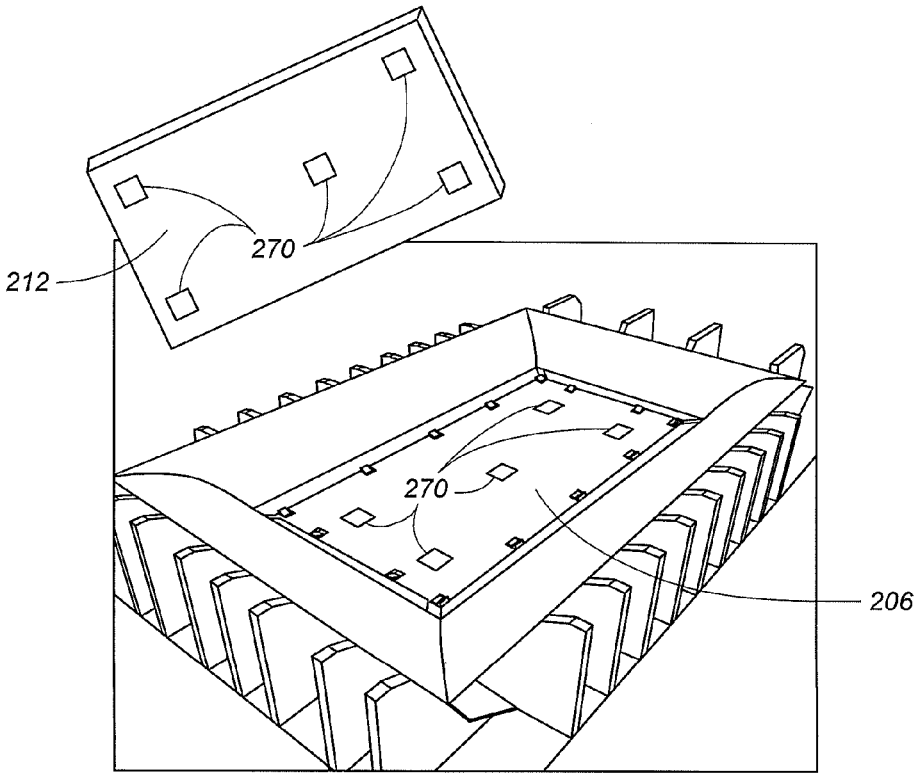

The center panel 212 is preferably attached to the base panel 206 in a manner such that the center panel 212 can be removed and replaced with ease. To this end, in an exemplary embodiment, the center panel 212 is attached to the base panel 206 using hook and loop (aka Velcro™) tabs 270 as shown in FIG. 7H. One tab 270 having one of either the hooks or the loops can be placed on the base panel 206 and the other tab 270 having the other of the hooks or the loops can be placed on the center panel 212. The tabs 270 on the base panel 206 and the center panel 212 are arranged such that they align to mate with one another when the center panel 212 is placed on the base panel 206.

It will be appreciated that by including a separate base panel 206 on which the center panel 212 may be mounted or affixed, the center panel 212 need not be held in place by a friction fit of the roll panels 216, 218, as was the case with the prior art. In turn, the roll panels 216, 218 need not be held in place by tension against a lip or ledge in the structure of the lid 108. As a consequence, the entire interior 200 may be placed as single unit into the casket lid 108 and secured in place by any other conventional means such as fasteners, hook and loop, and the like, for example, the base panel 206 may be coupled the underside of the casket lid 108 using staples, screws or nails while the center panel 212 is removed. The center panel 212 may then be replaced onto the interior 200.

The foregoing detailed description of one or more embodiments of the casket lid assembly has been presented herein by way of example only and not limitation. It will be recognized that there are advantages to certain individual features and functions described herein that may be obtained without incorporating other features and functions described herein. Moreover, it will be recognized that various alternatives, modifications, variations or improvements of the above-disclosed embodiments and other features and functions, or alternatives thereof, may be desirably combined into many other different embodiments, systems or applications. Presently unforeseen or unanticipated alternatives, modifications, variations or improvements therein may be subsequently made by those skilled in the art which are also intended to be encompassed by the appended claims. Therefore, the spirit and scope of any appended claims should not be limited to the description of the embodiments contained herein.

What is claimed is:

1. A casket head insert module to be inserted into a lid of a casket comprising:

a base panel having a top side and a bottom side;

at least one roll panel affixed to both the top side and the bottom side, the at least one roll panel comprising a front tab affixed to the bottom side and a back tab affixed to the top side; and a center panel supported on the top side.

2. The casket head insert module of claim 1 wherein the at least one roll panel is in a curved configuration when affixed to both the top side and the bottom side.

3. The casket head insert module of claim 1, the base panel further comprising:

a base panel body;

at least one base panel end, extending from and foldable relative to the base panel body; and at least one base panel side, extending from and foldable relative to the base panel body.

4. The casket head insert module of claim 3, wherein the base panel is in a concave configuration when the at least one base panel end and the at least one base panel side are folded relative to the base panel body.

5. The casket head insert module of claim 1, wherein the back tab and the front tab are affixed to the top side and the bottom side, respectively, by a fastener or adhesive.

6. A casket head insert module to be inserted into a lid of a casket comprising:

a base panel having a top side and a bottom side;

at least one roll panel affixed to both the top side and the bottom side; and a center panel supported on the top side, wherein:

the base panel is substantially rectangular having four edges; and the at least one roll panel comprises four roll panels, each of the four roll panels wrapping around one of the four edges when affixed to both the top side and the bottom side.

7. The casket head insert module of claim 6, the at least one roll panel further comprising:

a front tab affixed to the bottom side; and a back tab affixed to the top side.

8. The casket head insert module of claim 6, wherein the at least one roll panel is affixed to both the top side and the bottom side by a fastener or adhesive.

9. The casket head insert module of claim 6, the base panel further comprising:

a base panel body;

at least one base panel end, extending from and foldable relative to the base panel body; and at least one base panel side, extending from and foldable relative to the base panel body.

10. The casket head insert module of claim 9, wherein the base panel is in a concave configuration when the at least one base panel end and the at least one base panel side are folded relative to the base panel body.

11. The casket head insert module of claim 6 wherein the at least one roll panel is in a curved configuration when affixed to both the top side and the bottom side.

12. A method of constructing a casket head insert module to be inserted into a lid of a casket, comprising:

folding a base panel having a body portion and at least one base panel end into a concave configuration;

affixing at least one roll panel to the base panel end;

bending the at least one roll panel;

affixing the at least one roll panel to the body portion; and affixing a center panel to the body portion.

13. The method of claim 12, wherein:

the body portion is substantially rectangular having four edges;

the at least one base panel end comprises four base panel ends, one extending from each of the four edges.

14. The method of claim 13, wherein:

the at least one roll panel comprises four roll panels, one affixed to each of the four base panel ends.

15. The method of claim 14, wherein:

the center panel is affixed to the body portion between the four roll panels.

16. The method of claim 12, further comprising disposing the base panel on a frame such that the base panel is supported by the frame in the concave configuration.

17. The method of claim 16, wherein disposing the base panel on the frame further comprises aligning openings in the base panel with stops of the frame such that the stops extend at least partly through the openings.

* * * * *